United States Patent [19]

Vandenabeele et al.

[11] Patent Number: 4,820,615

[45] Date of Patent: Apr. 11, 1989

[54] PHOTOGRAPHIC SILVER HALIDE ELEMENT HAVING A PROTECTIVE LAYER COMPRISING BEADS OF RESINOUS MATERIAL AND WATER-INSOLUBLE WAX

[75] Inventors: Hubert Vandenabeele, Mortsel; Jacques L. Vervecken, Berchem, both of Belgium

[73] Assignee: Agfa-Gevaert, N.V., Mortsel, Belgium

[21] Appl. No.: 228,169

[22] Filed: Aug. 4, 1988

Related U.S. Application Data

[62] Division of Ser. No. 30,484, Mar. 27, 1987, Pat. No. 4,766,759.

[30] Foreign Application Priority Data

Apr. 8, 1986 [EP] European Pat. Off. ..... 86200592.3

[51] Int. Cl.[4] ..... G03C 1/76

[52] U.S. Cl. ..... 430/531; 430/523; 430/950; 430/961

[58] Field of Search ..... 430/523, 531, 950, 961

[56] References Cited

U.S. PATENT DOCUMENTS

| | | | |
|---|---|---|---|
| 3,811,924 | 5/1974 | Gallaeher et al. | 430/950 |
| 4,022,622 | 10/1977 | Timmermann et al. | 430/950 |
| 4,094,848 | 6/1978 | Naito | 430/950 |
| 4,396,706 | 8/1983 | Ishii et al. | 430/523 |
| 4,399,213 | 8/1983 | Watanabe et al. | 430/950 |
| 4,427,764 | 1/1984 | Tachibana et al. | 430/523 |
| 4,447,525 | 5/1984 | Vallarin et al. | 430/523 |
| 4,614,708 | 9/1986 | Timmerman et al. | 430/523 |

*Primary Examiner*—Jack P. Brammer
*Attorney, Agent, or Firm*—A. W. Breiner

[57] ABSTRACT

The present invention relates to photographic elements comprising a support and on one or on both sides of said support in the given order at least one photosensitive silver halide emulsion layer and at least one protective hydrophilic colloid layer comprising finely divided solid spherical beads having an average size ranging from 0.5 to about 20 μm, said beads comprising at least one photographically inert hydrophobic polymeric resinous material and, distributed throughout said resinous material, at least one water-insoluble wax, in a ratio by weight ranging from 10:0.1 to 10:5.

The present invention also relates to a method of making such photographic elements.

6 Claims, No Drawings

PHOTOGRAPHIC SILVER HALIDE ELEMENT HAVING A PROTECTIVE LAYER COMPRISING BEADS OF RESINOUS MATERIAL AND WATER-INSOLUBLE WAX

This is a division of application Ser. No. 07/030,484 filed Mar. 27, 1987, now U.S. Pat. No. 4,766,059.

DESCRIPTION

The present invention relates to a method of covering photographic elements comprising a support, and on one or on both sides of said support, at least one photosensitive silver halide emulsion layer with at least one protective hydrophilic colloid layer comprising finely divided solid spherical beads that contain a polymeric resinous material and a water-insoluble wax as well as to photographic elements comprising such beads.

Mechanical damage of photographic elements or adverse influencing of the photographic characteristics thereof are often incurred e.g. when a layer element is conveyed in dry state over or between rollers and contacting surfaces.

Dust formed inevitably during the cutting and sizing operation of photographic elements may remain between the stacked film sheets and cause scratch markings during the handling thereof. This is particularly the case with X-ray non-interleaved fold film, which is an X-ray material packed without interleaves.

It is generally known to protect photographic elements against mechanical damage or undesired adverse influences on their photographic characteristics by coating them with thin protective surface layers, usually thin hardened gelatin layers.

Protective gelatin surface layers, however, tend to slide with relative difficulty on surfaces with which they enter into moving contact.

It is also known in the photographic art to use light-sensitive silver halide elements containing particles or beads in a surface layer e.g. inorganic pigment particles such as finely divided silica particles or resin beads such as polymethyl methacrylate beads. Silica particles or resin beads can be incorporated into the surface layer(s) of photographic elements for the purpose of reducing the abrasion by dry-friction and reducing the scratchability of said photographic elements, when are stored, packed, or handled in contact with other materials.

It is also known to protect photographic elements against mechanical damage by coating them with a layer comprising a wax. This wax serves as a lubricant and for that reason tends to reduce the formation of scratch markings. However, some lubricants have a deleterious effect on the photosensitive silver halide emulsion, whilst others streak the film surface, thus spoiling the quality of the final image obtained.

In GB-A No. 1,320,564 a photographic material having a reduced tendency to become scratched was therefore described, which material comprises a support carrying a silver halide emulsion layer or an emulsion layer containing a developed silver image and as a protective surface layer a water-permeable colloid layer comprising a dispersed diester of a dicarboxylic acid.

In JA-A No. 159,221 a photographic material having improved sliding properties was described, which material comprises a hydrophthalic acid di-$C_{12}$–$C_{24}$alkyl ester or a hydrophthalic di-$C_8$–$C_{12}$fluoroalkyl ester in a surface layer.

In U.S. Pat. No. 4,427,764 a photographic silver halide material having improved slidableness and scratch resistance was described, which comprises at least one surface layer containing a di-$C_{12}$–$C_{24}$alkyl phthalate as lubricant.

In U.S. Pat. No. 4,399,213 a photographic silver halide material having improved surface characteristics was described, which comprises a support, a silver halide emulsion layer, and a protective layer composed of a plurality of non-photosensitive hydrophilic colloid layers, at least one of which contains oil particles comprising a lubricant, the outermost layer of the hydrophilic colloid layers containing matting particles e.g. polymethyl methacrylate.

However, the sticking tendency of these known materials when stored or packed in rolls or stacks is still high and scratch marks are formed.

Attempts are therefore still being made to substantially reduce the formation of scratch markings in stacked photographic elements.

In accordance with the present invention a method is provided of covering photographic elements comprising a support, and on one or on both sides of said support, at least one photosensitive silver halide emulsion layer with at least one protective hydrophilic colloid layer comprising finely divided solid spherical beads having an average size ranging from 0.5 to about 20 μm, characterized in that it comprises the steps of:

- dissolving at least one photographically inert hydrophobic polymeric resinous material and at least one water-insoluble wax, in a ratio by weight ranging from 10:0.1 to 10:5, in a sparingly water-miscible or water-immiscible low-boiling solvent or mixture of such solvents for both said resinous material and said wax,
- emulsifying the resulting solution in an aqueous solution of a hydrophilic colloid by homogenizing,
- removing said solvent or mixture of solvents by evaporation,
- adding the resulting dispersion to the aqueous coating composition for said protective hydrophilic colloid layer, and
- applying said aqueous coating composition onto the uppermost silver halide emulsion layer or layers to form said protective hydrophilic colloid layer or layers thereon.

The present invention also provides photographic elements comprising a support and on one or on both sides of said support in the given order at least one photosensitive silver halide emulsion layer and at least one protective hydrophilic colloid layer comprising finely divided solid spherical beads having an average size ranging from 0.5 to about 20 μm, characterized in that said beads comprise at least one photographically inert hydrophobic polymeric resinous material and, distributed throughout said resinous material, at least one water-soluble wax, in a ratio by weight ranging from 10:0.1 to 10:5.

It has been found surprisingly that in consequence of the presence of said water-insoluble wax distributed throughout the entire composition of the beads of resinous material that dust formed during the cutting and sizing operation of photographic elements comprising such beads has a substantially reduced scratching effect as compared with that of beads comprising no wax, so that during storage, packing, or handling of photographic elements according to the present invention the formation of scratch markings therein is diminished considerably.

The photographically inert hydrophobic polymeric resinous material is composed of at least one of the following types of material: cellulose derivatives e.g. cellulose nitrate, cellulose triacetate, cellulose acetate butyrate, polyamides, polystyrene, polyvinyl acetate, polyvinyl chloride, silicone resins, poly(acrylic ester) and poly(methacrylic ester) resins, fluorinated hydrocarbon resins, and graft polymers comprising a poly(-methacrylic ester) or polystyrene.

A non-limitative list of representative examples of these resinous materials are: poly(methyl methacrylate), poly(n-butyl methacrylate), poly(isobutyl methacrylate), copolymers of n-butyl methacrylate) and isobutyl methacrylate, copolymers of vinylidene fluoride and hexafluoropropylene, copolymers of vinylidene fluoride and trifluorochloroethylene, copolymers of vinylidene fluoride and tetrafluoroethylene, terpolymers of vinylidene fluoride, hexafluoropropylene, and tetrafluoroethylene, poly(vinylidene fluoride), polytetrafluoroethylene, poly(methyl methacrylate) with a graft copolymer of methyl methacrylate and co(styrene/maleic acid monosodium salt), polystyrene with a graft copolymer of styrene and co(styrene/maleic acid monosodium salt), poly(methyl methacrylate) with a graft copolymer of methyl methacrylate and polyethylene oxide, poly(-methyl methacrylate) with a graft copolymer of methyl methacrylate and co(acrylic acid/styrene sodium salt), poly(methyl methacrylate) with a graft copolymer of methyl methacrylate and co(vinyl alcohol/vinyl acetate), poly(methyl methacrylate) with a graft copolymer of methyl methacrylate and poly-N-vinyl pyrrolidone, and poly(methyl methacrylate) with a graft copolymer of methyl methacrylate and co(styrene/-2-acryloyloxyethyl monomaleinate/maleic acid sodium salt).

The above-mentioned poly(methyl methacrylate) is preferred for use as the photographically inert hydrophobic polymeric resinous material in accordance with the present invention.

The water-insoluble wax used for the purpose of the present invention can be any of the water-insoluble thermoplastic wax-like materials of the known six classes of waxes i.e. vegetable waxes, insect waxes, animal waxes, mineral waxes, petroleum waxes, synthetic waxes, as well as the water-insoluble wax-like components that occur individually in these waxes, more particularly long-chain hydrocarbons, fatty saturated and unbranched acids and alcohols, as well as the ethers and esters of aliphatic monohydric alcohols.

The petroleum waxes are compositions consisting mainly of a mixture of long-chain hydrocarbons, whereas the vegetable, animal, insect, and mineral waxes are usually compositions made up largely of esters formed in nature by the union of higher alcohols with the higher fatty acids, e.g. carnauba wax, wool wax, and montan wax. Associated with these esters are one or more of the following components, which vary greatly in amount depending on the source of the wax: free saturated and unbranched fatty acids and monohydric alcohols and long-chain hydrocarbons, to mention the most important.

In general, the wax-like materials for use according to the invention are fusible, thermoplastic materials, which often are opaque in solid state and have properties closely resembling those of bees wax. They differ from related natural and synthetic products such as oils, fats, gums, and resins i.a. in that they change from solid into liquid state at temperatures generally between 20° and 100° C. (exceptionally at temperatures up to 200° C., which applies in particular to certain synthetic waxes) and that they have a low melt viscosity.

The following is a non-limitative list of water-insoluble waxes and wax-like materials suitable for use in accordance with the present invention:

A. Vegetable waxes:
- carnauba wax
- ouricury wax
- candelilla wax
- sugercane wax
- japan wax.

B. Animal waxes:
- spermacetic wax
- wool wax.

C. Insect waxes:
- bees wax
- chinese insect wax
- shellac wax.

D. Petroleum waxes:
- paraffin waxes of various grades such as paraffin 136–138, which means paraffin melting at 136°–138° F. (=58°–59° C.)
- petroleum wax.

E. Mineral waxes:
- ozocerit wax
- ceresin
- Utah wax
- peat wax
- montan wax.

F. Synthetic waxes or wax-like materials:
1. Wax-like components that occur individually in natural waxes more particularly:
   - (a) the wax-like fatty saturated alcohol: hexadecyl alcohol and octadecyl alcohol and mixtures thereof such as lanetta wax,
   - (b) the wax-like straight-chain saturated fatty acids of the formula $C_nH_{2n+1}COOH$, in which n is an integer of at least 11, particularly myristic acid, palmitic acid, and stearic acid,
   - (c) synthetic esters derived from carboxylic acids and alcohols:
     - n-hexadecyl palmitate
     - n-octadecyl stearate
     - n-hexadecyl myristate.
2. Other synthetic esters derived from fatty acids such as:
   - the wax-like esters sold under the trade mark GLYCO WAX S 932 by Glyco Chemicals Inc., New York, N.Y., U.S.A.,
   - pentaerythritol esters of fatty acids, e.g. of stearic acid, palmitic acid, and lauric acid such as PETETRASTEARATE(trade mark for a pentaerythritol tetrastearate marketed by Hercules Powder Cy. Inc., Wilmington, Del., U.S.A.),
   - alkyl esters of 12-hydroxy-stearic acid such as octadecyl-12-hydroxystearate,
   - sucrose diesters of fatty acids such as sucrose distearate (trade mark SES-2, T-1 by Sucrose Chemical Division of Colonial Sugars Company, Gramercy, La., U.S.A.),
   - esters of fatty acids and hexitol anhydrides derived from sorbitol such as sorbitol monostearate (trade marks SPAN 60 and ARLACEL 60), sorbitol monopaltmitate, and sorbitol tristearate.

3. Synthetic paraffin waxes e.g. those known as the Fisher-Tropsch waxes, which are long-chain aliphatic hydrocarbons.
4. The hydrogenated oils e.g. hydrogenated castor oil and sperm oil such as CASTORWAX (trade mark for hydrogenated castor oil of the Baker Castor Oil Co., Bayonne, N.J. U.S.A.), and SPERMAFOL 52 (trade mark for hydrogenated sperm oil of Archer Daniel Midland Co., Minneapolis, Minn., U.S.A.).
5. Chemically modified natural waxes i.a.:
   (a) the halogenated hydrocarbons such as chlorinated paraffins,
   (b) the partly oxidized paraffins,
   (c) montan wax derivatives such as the Hoechst waxes formerly known as I.G.-waxes or Gersthofen Waxes, which generally are glycerol, glycol, or polymerized ethylene glycol esters of acids from montan wax.
6. Amide derivatives of fatty acids e.g. stearamide such as GOUDAMIDE-S (trade mark for stearamide of Gouda-Apollo N.V., Gouda, The Netherlands), the waxes sold under the trade mark CERAMID and the trade mark ACRAWAX for stearic acid monoethanolamide and for the reaction product of hydrogenated castor oil with monoethanolamine respectively, the CARLISLE Waxes (trade mark of Carlisle Chemical Works, Reading Ohio, U.S.A. for amide waxes) such as CARLISLE 280 WAX (trade mark for N,N-ethylene-bis-stearamide) and CARLISLE 400 WAX (trade mark for a N,N-alkylene-bis fatty acid amide).

For more details about water-insoluble waxes and wax-like thermoplastic materials there can be referred to "The Chemistry and Technology of Waxes", by A. H. Warth, 2nd Ed., 1956, Reinhold Publishing Corporation, New York, U.S.A. and to "Industrial Waxes" Vol. I, by H. Bennett, 1963, Chemical Publishing Company Inc., New York, U.S.A.

As a guide for selecting waxes that are suited for use according to the present invention, the requirements to be met by such waxes to achieve optimal results are given hereinafter.

The waxes should, of course, be chemically inert towards the photographic emulsion ingredients, the photographic colloid, and the photographic processing baths. They must not impair the light-sensitivity and the developability of the silver halide nor should they cause fogging. They should preferably have a sufficiently low refractive index to enable the beads of resinous material and wax to have approximately the same index of refraction as the hydrophilic colloid of said protective hydrophilic colloid layer and as the hydrophilic colloid employed as binder of said photosensitive silver halide emulsion layer, thereby minimizing the opacity or light-scattering of these layers. They should readily dissolve together with the polymeric resinous material in the low-boiling solvent or in a mixture of low-boiling solvents.

Sometimes it may be impossible to find a wax that satisfies all the requirements set. It may then be necessary to combine one wax having a given desired property with another wax having another desired property. In general, a wax or a combination of waxes is chosen, which possesses the most adequate combination of properties. For instance a certain amount of beeswax or carnauba wax can be mixed with low-melting paraffin wax to raise the melting point of the paraffin wax. Another example is the addition of ozocerite wax, which is soft and plastic, to a paraffin wax of approximately the same melting point, but which is hard and lacks plasticity. Further it may be desirable to use a mixture of waxes in such proportions as to obtain the desired refractive index. Thus, it is possible to use so-called blended waxes with natural waxes or mixtures of hydrocarbon waxes with synthetic waxes.

The term "water-insoluble wax" as used in the present specification, therefore, does not necessarily refer to one single wax compound but also encompasses a mixture of two or more such compounds.

Preferred examples of water-insoluble waxes for use in accordance with the present invention are the water-insoluble mono- or di-esters of carboxylic acids and monohydric alcohols. Because they do not substantially opacify the layers containing them, the best representatives of this class of waxes are the di-$C_{12}$–$C_{24}$alkyl phthalates, e.g. di-n-dodecyl phthalate, di-n-tetradecyl phthalate, di-n-hexadecyl phthalate, di-n-octadecyl phthalate, and di-n-eicosyl phthalate; and the $C_{12}$–$C_{24}$alkyl esters of $C_{12}$–$C_{24}$alkanoic acids e.g. n-hexadecyl myristate, n-hexadecyl palmitate, and n-octadecyl stearate. Di-n-octadecyl phthalate offers the best combination because it has no opacifying influence and has a favourable antiscratching effect.

According to a preferential embodiment of the present invention poly(methyl methacrylate) is used as the photographically inert hydrophobic polymeric resinous material in combination with di-n-octadecyl phthalate as the water-insoluble wax.

The low-boiling solvents that can be used in accordance with the present invention for dissolving both the resinous material and the wax have a solubility in water of at most 25% by weight at room temperature (20° C.). Solvents having a solubility in water comprised between 0 and 10% by weight at room temperature are preferred. Moreover, such solvents preferably have a boiling point of at most 120° C. and they have a sufficiently high vapour pressure so that they can be removed from said dispersion by applying a vacuum of 500 to 10 mm Hg at a temperature of 25° to 80° C.

Examples of sparingly water-miscible or water-immiscible low-boiling solvents that can be used in accordance with the present invention are e.g. methylene chloride, methyl formate, ethyl formate, n-butyl formate, methyl acetate, ethyl acetate, n-propyl acetate, isopropyl acetate, butyl acetate, methyl propionate, ethyl propionate, carbon tetrachloride, sym-dichloroethane, trichloroethylene, 1,2-dichloropropane, chloroform, amyl chloride, ethyl methyl ketone, diethyl ketone, methyl n-propyl ketone, cyclohexane, methyl cyclohexane, ligroin (boiling range: 60°–110° C.), benzene, toluene, and nitromethane.

A mixture of 50% by volume of methylene chloride, 30% by volume of ethyl methyl ketone, and 20% by volume of ethyl acetate is preferred for dissolving the combination of poly(methyl methacrylate) as resinous material and di-n-octadecyl phthalate as water-insoluble wax.

The process of dissolving said resinous material and said water-insoluble wax in low-boiling solvents, emulsifying the resulting solution in an aqueous solution of a hydrophilic colloid by homogenizing, and removing the solvents by evaporation, is carried out in such a manner that dispersed solid spherical beads having an average diameter generally ranging from about 0.5 to about 20 μm remain in the hydrophilic colloid.

According to a preferred embodiment of the present invention the average size of the dispersed solid spherical beads ranges from about 2.5 to about 10 μm.

The dispersion of beads formed in the hydrophilic colloid can be added as such to the aqueous coating composition for the protective hydrophilic colloid layer or layers of a photographic element or it can be added together with any appropriate additives.

The dispersion can be prepared in bulk and can be stored for a long time without loosing its effectiveness with respect to the desired reduction or prevention of scratch markings in photographic elements that are made later on using the dispersion in accordance with the method of the present invention. A batch can be taken at any moment from the bulk and be added to an aqueous hydrophilic colloid coating composition for forming a protective layer of a photographic element, to realize in the final product the desired reduction of scratch markings.

The amount of sparingly water-miscible or water-immiscible low-boiling solvent or mixture of such solvents used in the preparation of the dispersion depends on the solubility of the specific resinous material and of the specific wax therein. It may vary between very wide limits but is preferably limited to a minimum value, which minimum value can easily be established by making a few comparative tests.

The dispersing of the solution into said aqueous solution of a hydrophilic colloid can be assisted by means of high speed stirrers, homogenizers (single or double stage homogenizers), colloid mills or ultrasonic wave generators.

The removal of the sparingly water-miscible or water-immiscible low-boiling solvent or mixture of such solvents is effected by evaporation and, whenever desired, this removal can be accelerated or facilitated by applying reduced pressure and/or moderate heating.

The photographically inert hydrophobic polymeric resinous material and the water-insoluble wax are used in a weight ratio ranging from 10:0.1 to 10:5. Optimal results are obtained with a weight ratio ranging from 10:0.7 to 10:2.

The photographically inert hydrophobic polymeric resinous material used in accordance with the present invention is employed in quantities of 10 to 100 mg per $m^2$ of the protective hydrophilic colloid layer or layers coated on the uppermost silver halide emulsion layer or layers of the photographic element.

Although preferably an aqueous gelatin solution is used as said aqueous solution of a hydrophilic colloid, into which the solution of the resinous material and the water-insoluble wax is to be emulsified, aqueous solutions of other hydrophilic and water-permeable film-forming substances, e.g. of proteins other than gelatin, cellulose derivatives such as alkyl cellulose e.g. hydroxyethyl cellulose or carboxymethyl cellulose, alginic acid and derivatives thereof, gum arabic, polyvinyl alcohols, polyvinyl pyrrolidone and even mixtures thereof can be employed as well.

Likewise gelatin is preferably used as hydrophilic colloid of the aqueous coating composition, to which the dispersion is to be added before this aqueous hydrophilic colloid coating composition is applied onto the uppermost silver halide emulsion layer or layers to form the protective hydrophilic colloid layer or layers thereon. Of course, the other hydrophilic and water-permeable film-forming substances mentioned above can also be employed instead of gelatin or can be combined therewith.

Ingredients such as i.a. plasticizers, filling agents, hardening accelerators, anti-Newton additives, antistatic agents, and surface-active agents can also be added to the aqueous hydrophilic colloid coating composition for forming the protective hydrophilic colloid layer.

Suitable surface-active agents that can be added to the aqueous hydrophilic colloid coating composition for forming the protective hydrophilic colloid layer have been described in UK P Nos. 1,293,189 and 1,460,894, in BE P No. 742,680, and in U.S. Pat. No. 4,292,402. A survey of surface-active agents that can be added to the aqueous hydrophilic colloid coating composition can be found in Gerhard Gawalek's "Wasch- und Netzmittel" Akademieverlag, Berlin (1962). Examples of suitable surface-active agents are the sodium salt of N-methyl-oleyltauride, sodium stearate, heptadecenylbenzimidazole sulphonic acid sodium salt, sodium sulphonates of higher aliphatic alcohols e.g. 2-methyl-hexanol sodium sulphonate, sodium diisooctyl-sulphosuccinnate, sodium dodecyl sulphate, tetradecyl benzene sulphonic acid sodium salt. Other interesting surface-active agents are the fluorinated surface-active agents like e.g. perfluorocaprylic acid ammonium salt.

Suitable antistatic agents that can be added to the aqueous hydrophilic colloid coating composition for forming the protective hydrophilic colloid layer have been described in EU-A No. 0,180,668.

It is also possible to admix the beads obtained according to the present invention in the aqueous hydrophilic colloid coating composition for forming the protective hydrophilic colloid layer partially with other beads such as those obtained according to the method described in EU-A No. 0,080,225. These polymer beads have an average size ranging from about 0.5 to about 5 μm, but it is possible to prepare larger beads having an average size of up to about 10 μm.

The silver halide used in the preparation of the photosensitive silver halide emulsion layer or layers of photographic elements according to the present invention can be silver bromide, silver iodide, silver chloride, or mixed silver halides e.g. silver chlorobromide, silver bromoiodide, and silver chlorobromoiodide.

The photosensitive silver halide emulsion layer or layers of photographic elements according to the present invention may contain the usual additives such as e.g. stabilizers, fog-inhibitors, speed-increasing compounds, colloid hardeners, plasticizers, etc. The silver halide emulsions may be spectrally sensitized or non-spectrally sensitized.

The support of photographic elements according to the present invention can be a transparent film support as well as a non-transparent support.

When the support of the photographic element for use in accordance with the present invention is a non-transparent support, it usually is a paper support, preferably paper coated on one side or on both sides with an Alpha-olefin polymer, e.g. polyethylene.

Any conventional transparent hydrophobic resin film made of a cellulose ester e.g. a cellulose triacetate, a polyester e.g. polyethylene terephthalate, polyvinylacetal, and polystyrene can be used as transparent film support. These hydrophobic resin film supports are preferably coated with at least one subbing layer to improve the adherence thereto of hydrophilic colloid layers e.g. of silver halide emulsion layers. Suitable subbing layers for that purpose have been described in e.g. U.S. Pat. No. 3,495,984; U.S. Pat. No. 3,495,985; U.S. Pat. No. 3,434,840; U.S. Pat. No. 3,788,856; and GB A No. 1,234,755.

The support of photographic elements according to the present invention can thus carry on one or on both sides thereof and in the given order: at least one subbing layer, at least one photosensitive silver halide emulsion layer, and at least one protective hydrophilic colloid layer comprising the finely divided solid spherical beads that contain a polymeric resinous material and a waxy lubricant.

The photographic elements according to the present invention can be of various types e.g. X-ray photographic elements including both medical type and industrial type for non-destructive testing, photographic elements for graphic arts and for so-called amateur and professional photography, continuous tone or high contrast photographic elements, photographic elements including image-receiving elements for silver complex or color diffusion transfer processes, photographic elements comprising non-spectrally sensitized emulsions or spectrally sensitized emulsions, high-speed or low-speed photographic elements, and black-and-white or colour photographic elements.

The following examples illustrate the present invention.

EXAMPLE 1

A dispersion of beads in aqueous gelatin was made as follows according to the method of the present invention.

An amount of 10 parts by weight of commercially available polymethyl methacrylate powder and 1 part by weight of di-n-octadecyl phthalate was dissolved in a mixture of solvents consisting of 50% by volume of methylene chloride, 30% by volume of ethyl methyl ketone, and 20% by volume of ethyl acetate, to make a 10% solution. The resulting solution was emulsified in a 10% by weight aqueous solution of gelatin by stirring. The mixture of solvents was then removed by evaporation, so that beads dispersed in aqueous gelatin were obtained, said beads having an average size of about 5 μm.

In a first step the beads were separated, weighed, dried at 100° C., and weighed again. A loss of 33.5% by weight was found. Pyrolysis and a combined gas chromatographic/mass spectrographic analysis gave evidence of the presence of both polymethyl methacrylate and di-n-octadecyl phthalate in the beads.

In a second step, a batch of 1 g of these dried beads was rinsed for 2 h at 20° C. with 100 ml of n-hexane, which is a solvent for di-n-octadecyl phthalate but not for polymethyl methacrylate at 20° C. The beads were dried again showing a loss of weight of 3.9%. Pyrolysis and combined gas chromatographic/mass spectrographic analysis of the rinsed beads gave clear evidence of the presence of di-n-octadecyl phthalate, which most probably originates from the immediate surface of the beads.

In a third step, an amount of 1 g of dry beads obtained after the rinsing of step 2, was rinsed for 16 h at 20° C. with 100 ml of n-hexane. The beads were dried again showing a loss of weight of 3.2%. Because any di-n-octadecyl phthalate present at the very surface of the beads must have been dissolved away already during the second step, the dissolving action of the n-hexane solvent towards the di-n-octadecyl phthalate solute during this third step must have been directed inevitably to di-n-octadecyl phthalate present in the interior of the beads. Pyrolysis and combined gas chromatographic/mass spectrographic analysis of the rinsed beads again gave clear evidence of the presence of di-n-octadecyl phthalate.

In a fourth step, an amount of 1 g of dry beads obtained after the rinsing of step 3, was rinsed for 1 h at 50° C. with 100 ml of n-hexane, which at this increased temperature also slightly dissolves polymethyl methacrylate. The beads were dried again showing a loss of weight of 2.0%. By now, the dissolving action of the n-hexane solvent must have been directed certainly to di-n-octadecyl phthalate present deep in the interior of the beads. Pyrolysis and combined gas chromatographic/mass spectrographic analysis of the rinsed beads again gave clear evidence of the presence of di-n-octadecyl phthalate.

The fact that di-n-octadecyl phthalate was still present in the beads after the third and the fourth step, proved that it must have been homogeneously distributed throughout the entire composition of the beads made according to the method of the present invention.

EXAMPLE 2

Test layers were prepared as follows.

Different waxes as identified in Table 1 hereinafter were dissolved each together with polymethyl methacrylate in a ratio by weight of 1 to 10 parts in a solvent to make a 10% solution. The solvent was made up of 50% by volume of methylene chloride, 30% by volume of ethyl methykl ketone, and 20% by volume of ethyl acetate. Each of the resulting solutions was coated in an identical way on a support and dried. A comparable layer was made in the same way with polymethyl methacrylate comprising no wax and another layer was coated with di-n-octadecyl phthalate alone.

The friction coefficient of each of the resulting layers was determined by dragging the layer over a stainless steel surface. During a second measurement of the friction two layers of identical composition were pulled over each other. The value given for static friction is the maximum value measured from the start of the pulling operation up to 2.2 s after the start. The value given for dynamic friction is the maximum value measured from 4.7 to 15 s after the start. In the case of di-n-octadecyl phthalate (alone) the value of dynamic friction is higher than the value of static friction. This is mainly due to the adhesive power of the wax sample and/or grooving thereof in consequence of plasticity.

The results of the friction measurements are listed in Table 1.

TABLE 1

| Wax | Frict. coeff. Static | (stainl. steel) Dynamic | Friction coeff. Static | (same layer) Dynamic |
|---|---|---|---|---|
| PMM (alone) | 0.32 | 0.30 | 0.38 | 0.37 |
| PMM + A | 0.12 | 0.10 | 0.24 | 0.17 |
| PMM + B | 0.15 | 0.12 | 0.22 | 0.14 |
| PMM + C | 0.20 | 0.18 | 0.22 | 0.17 |
| PMM + D | 0.15 | 0.11 | 0.20 | 0.12 |
| PMM + E | 0.18 | 0.17 | 0.17 | 0.15 |
| PMM + F | 0.16 | 0.12 | 0.15 | 0.14 |
| PMM + G | 0.19 | 0.15 | 0.17 | 0.14 |
| G (alone) | 0.26 | 0.44 | 0.44 | 0.46 |

The symbols used in Table 1 have the following significances:

PMM=polymethyl methacrylate
A=carnauba wax
B=bees wax
C=pentaerythritrol tetrastearate
D=candelilla wax
E=sorbitol monopalmitate
F=sorbitol tristearate
G=di-n-octadecyl phthalate From the results listed in Table 1 it can be concluded that the friction coefficients of the combinations of polymethyl methacrylate with a water-insoluble wax are significantly lower than those obtained with polymethyl methacrylate alone.

The reduced friction exerted by the beads of the invention or by debris thereof, which comprise the combinations of polymethyl methacrylate with a water-insoluble wax, leads to less scratching of photographic elements comprising such beads.

It also surprises that the friction coefficients of di-n-octadecyl phthalate (G) alone are worse than those of the combination of polymethyl methacrylate with di-n-octadecyl phthalate.

EXAMPLE 3

A gelatin silver bromoiodide (2 mol % of iodide) X-ray emulsion comprising per kg of emulsion 65 g of gelatin was coated on both sides of a subbed polyethylene terephthalate support at a ratio of about 23 m2 per kg of emulsion per side of the support. Each resulting emulsion layer had a silver content per m2, which was equivalent to 5.0 g of silver nitrate.

Both emulsion layers while still wet were covered with an aqueous coating composition for forming protective gelatin layers thereon, said composition comprising:

| | |
|---|---|
| gelatin | 40 g |
| dispersion of beads prepared as described in Example 1 | 30 g |
| perfluorocaprylic acid ammonium salt | 10 ml |

-continued

| | |
|---|---|
| 5% aqueous solution of sodium diisooctyl sulphonsuccinate | 18 ml |
| formol (4% aqueous solution) | 16 ml |
| water to make | 1000 ml |

The protective gelatin layers comprising beads having an average size of about 5 μm were coated at a ratio of 1.1 g of gelatin per m2, each layer having a thickness of 29 μm.

A photographic element made in this way in accordance with the method of the present invention was very resistant to abrasion and scratching.

We claim:

1. Photographic element comprising a support and on one or on both sides of said support in the given order at least one photosensitive silver halide emulsion layer and at least one protective hydrophilic colloid layer comprising finely divided solid beads having an average size ranging from 0.5 to about 20 μm, wherein said beads comprise at least one photographically inert hydrophobic polymeric resinous material and, distributed throughout said resinous material, at least one water-insoluble wax, in a ratio by weight ranging from 10:0.1 to 10:5.

2. A photographic element according to claim 1, wherein said photographically inert hydrophobic polymeric resinous material is poly(methyl methacrylate).

3. A photographic element according to claim 1, wherein said water-insoluble wax is a mono- or di-ester of a carboxylic acid and a monohydric alcohol.

4. A photographic element according to claim 3, wherein said mono- or di-ester of a carboxylic acid and a monohydric alcohol is di-n-octadecyl phthalate.

5. A photographic element according to claim 1, wherein said finely divided solid spherical beads have an average size ranging from about 2.5 to about 10 μm.

6. A photographic element according to claim 1, wherein the weight ratio of said photographically inert hydrophobic polymeric resinous material to said water-insoluble wax ranges from 10:0.7 to 10:2.

* * * * *